US010189612B2

(12) United States Patent
Green

(10) Patent No.: US 10,189,612 B2
(45) Date of Patent: Jan. 29, 2019

(54) BIN AND LID LOCKING BANDS AND METHODS OF USING THE SAME

(71) Applicant: U.S. MERCHANTS FINANCIAL GROUP, INC., Beverly Hills, CA (US)

(72) Inventor: Jeff Green, Beverly Hills, CA (US)

(73) Assignee: U.S. Merchants Financial Group, Inc., Beverly Hills, CA (US)

( * ) Notice: Subject to any disclaimer, the term of this patent is extended or adjusted under 35 U.S.C. 154(b) by 0 days.

(21) Appl. No.: 15/480,290

(22) Filed: Apr. 5, 2017

(65) Prior Publication Data

US 2018/0290795 A1 Oct. 11, 2018

(51) Int. Cl.
*B65D 45/32* (2006.01)

(52) U.S. Cl.
CPC ..... *B65D 45/32* (2013.01)

(58) Field of Classification Search
CPC ..... B65D 45/00–45/32
USPC ..... 220/319, 23.6, 781, 380; 206/499, 501, 206/503, 504–507, 508
See application file for complete search history.

(56) References Cited

U.S. PATENT DOCUMENTS 2,714,469 A 8/1955 Carlson
3,429,605 A 2/1969 Soesbergen
3,886,047 A * 5/1975 Billups, Jr. ..... C12M 23/10 220/319
4,379,455 A * 4/1983 Deaton ..... A61M 1/0001 220/319
4,723,679 A * 2/1988 Sinchok ..... B65D 21/083 220/319
5,129,537 A 7/1992 Bordner et al.
5,193,864 A 3/1993 Coleman
5,368,182 A * 11/1994 Schutz ..... B65D 45/02 220/319
5,605,244 A 2/1997 Bradshaw
5,713,482 A 2/1998 Bordner et al.
5,915,557 A * 6/1999 Levine ..... B65D 21/0224 206/509
5,934,486 A * 8/1999 Jarvis ..... A47B 81/04 211/126.12
5,947,320 A 9/1999 Bordner et al.
6,142,330 A * 11/2000 Sacks ..... B65D 45/30 206/503
6,401,958 B1 6/2002 Foss et al.
8,870,013 B2 * 10/2014 Alvares ..... B65D 43/0249 215/274
2005/0006390 A1 1/2005 Wang

* cited by examiner

*Primary Examiner* — Kareen K Thomas
(74) *Attorney, Agent, or Firm* — Lewis Roca Rothgerber Christie LLP

(57) ABSTRACT

A locking band for securing a lid to a container. The locking band includes a first arm and a second arm configured to mate with the first arm. The first and second arms are configured to move between a disengaged position and an engaged position. The locking band also includes an inwardly-facing channel defined by the first and second arms configured to receive a peripheral portion of the lid and a corresponding peripheral portion of the container. At least one alignment pin is provided at a first end of one of the first and second arms, and at least one alignment receptacle is defined at a first end of the other one of the first and second arms to receive the alignment pin when the first and second arms are in the engaged position.

20 Claims, 16 Drawing Sheets

BIN AND LID LOCKING BANDS AND METHODS OF USING THE SAME

FIELD

The present disclosure relates generally to locking bands for securing storage bins and lids together.

BACKGROUND

Lids and containers are used to store and/or transport a variety of items. Lids are conventionally secured to containers by installing two or more locks (e.g., a combination or key padlock) through one or more pairs of corresponding openings in the lid and the container. However, installing and removing these locks may time-consuming and/or cumbersome. Additionally, a series of discrete locks does not supply uniform pressure around the entire periphery of the interface between the lid and the container. Instead, greater pressure is applied at the discrete locations at which the locks are installed compared to the regions between the locks. Accordingly, the lid may be susceptible to separate from the container in the regions that are not engaged by the one or more locks. Depending on the nature of the contents stored in the container, the separation between the lid and the container may permit the contents to be undesirably accessed while the lid is still locked to the container and/or may permit the contents to fall out of the container.

SUMMARY

The present disclosure is directed to various embodiments of a locking band for securing two components together, such as a lid to a container. In one embodiment, the locking band includes a first arm and a second arm configured to mate with the first arm. The first and second arms are configured to move between a disengaged position and an engaged position. The locking band also includes an inwardly-facing channel defined by the first and second arms that is configured to receive a peripheral portion of the lid and a corresponding peripheral portion of the container. One or more alignment pins are at a first end of one of the first and second arms. One or more alignment receptacles are defined at a first end of the other one of the first and second arms. The one or more alignment receptacles are configured to receive the one or more alignment pins when the first and second arms are in the engaged position.

The one or more alignment pins may be cylindrical projections extending outward from the first end of the first arm and the one or more alignment receptacles may be cylindrical blind holes extending inward from the first end of the second arm. The locking band may have a rectangular shape when the first and second arms are in the engaged position. The inwardly-facing channel may be defined by a first flange configured to engage a surface of the peripheral portion of the lid, a second flange spaced apart from the first flange configured to engage a surface of the peripheral portion of the container, and a sidewall extending between the first and second flanges. The locking band may also include at least one notch defined in the second flange that is configured to expose a portion of the surface of the peripheral portion of the container. The notch may be defined by a first notch segment proximate the first end of the first arm and a second notch segment proximate the first end of the second arm configured to cooperate with the first notch segment when the first and second arms are in the engaged position. The locking band may also include a first lug at a second end of the first arm and a second lug at a second end of the second arm that is configured to contact the second lug when the first and second arms are in the engaged position.

A locking band according to another embodiment of the present disclosure includes a first arm and a second arm configured to mate with the first arm. The first and second arms are configured to move between a disengaged position and an engaged position. The locking band also includes an inwardly-facing channel defined by the first and second arms that is configured to receive a peripheral portion of the lid and a corresponding peripheral portion of the container. The locking band also includes a hinge at first ends of the first and second arms. The hinge is configured to facilitate rotating the first and second arms between the disengaged and engaged positions. The hinge includes a pin at the first end of one of the first and second arms and a receptacle configured to receive the pin at the first end of the other one of the first and second arms.

The locking band may also include a lap joint defined at the first ends of the first and second arms. The inwardly-facing channel may be defined by a first flange configured to engage a surface of the peripheral portion of the lid, a second flange spaced apart from the first flange configured to engage a surface of the peripheral portion of the container, and a sidewall extending between the first and second flanges. The locking band may also include a first notch defined in the second flange of the first arm and a second notch defined in the second flange of the second arm to expose portions of a surface of the peripheral portion of the container. The second notch may be opposite to the first notch when the first and second arms are in the engaged position. The locking band may also include a fastener-receiving mechanism configured to facilitate locking the first and second arms in the engaged position. The fastener-receiving mechanism may be opposite the hinge when the first and second arms are in the engaged position.

A locking band according to another embodiment of the present disclosure includes a band configured to engage a surface of a peripheral portion of the lid, a series of hooks extending in a first direction from the band, and a series of prongs extending in the first direction from the band. The hooks configured to extend through a first set of aligned openings in the lid and the container and the prongs are configured to extend through a second set of aligned openings in the lid and the container.

The band may be a monolithic rectangular member including a substantially planar surface configured to engage the surface of the peripheral portion of the lid and a rounded surface opposite to the substantially planar surface. Each hook may include a stem having a supported end at the band and a free end opposite to the supported end, an engagement tab extending outward from the free end of the stem. The stem is configured to extend through one of the aligned openings of the first set of aligned openings in the lid and the container and the engagement tab is configured to underlap a portion of the container. Each hook may be L-shaped. Each prong may be a cylindrical member. The hooks may be opposite the prongs. The band may include a pair of relatively longer segments and a pair of relatively shorter segments. The series of hooks may be arranged along one of the relatively longer segments and the series of prongs may be arranged along the other one of the relatively longer segments.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

DETAILED DESCRIPTION

Figure 1A:
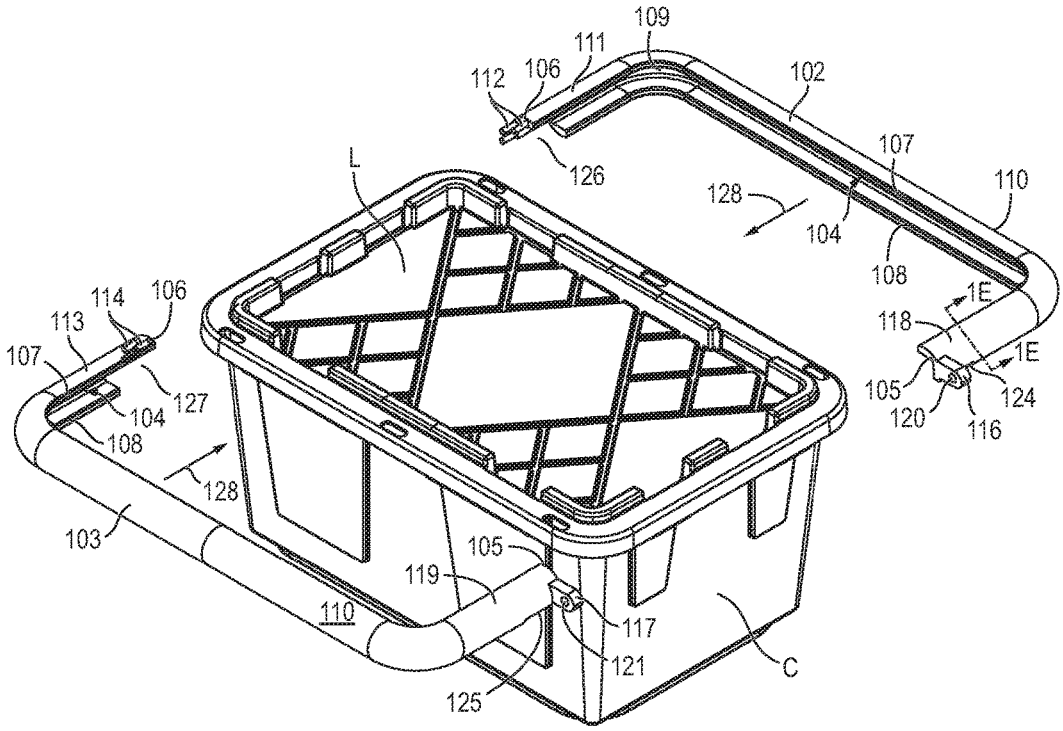
FIGS. 1A-1D illustrate a perspective view, a top view, a side view, and an end view, respectively, of a locking band according to one embodiment of the present disclosure in a disengaged position.

The present disclosure is directed to various embodiments of a locking band for securing together two or more components, such as a lid (e.g., a cover) to a container (e.g., a storage bin). In some embodiments, the locking bands of the present disclosure are configured to wrap around or generally extend entirely around a periphery of the lid and/or a periphery of the container, which supplies a uniform and continuous or substantially uniform and continuous pressure at the interface between the lid and the container to more securely retain the contents stored in the container.

With reference now to FIGS. 1A-1I, a locking band 100 according to some embodiments of the present disclosure includes a first arm or arm 102 (e.g., a left arm) and a second arm or arm 103 (e.g., a right arm) configured to engage the first arm 102. The first and second arms 102, 103 are configured to move between an open, disengaged configuration (as shown in FIGS. 1A-1D) and a closed, engaged position (as shown in FIGS. 1F-1I). In the closed, engaged position, the locking band 100 is configured to releasably secure together two or more components. In FIGS. 1A-1I, the locking band 100 is shown securing a lid L (e.g., a cover) to a container C (e.g., a storage bin) in a closed configuration, although the locking band 100 of the present disclosure may be configured and utilized to secure together any other suitable components with interfacing structures. Additionally, in the illustrated embodiment, when the arms 102, 103 are in the closed configuration, the locking band 100 has a rectangular shape having a pair of opposing relatively longer sides and a pair of opposing relatively shorter ends that match or substantially match the shape of the interfacing peripheral portions of the lid L and the container C that the locking band 100 is configured to secure together. In one or more embodiments, the locking band 100 may have any other suitable shape (e.g., a circular shape or any other polygonal shape) depending on the configuration of the components (e.g., the lid L and the container C) that the locking band 100 is configured to releasably secure together in a closed or locked configuration. Additionally, although in the illustrated embodiment the band 100 includes two arms 102, 103, in one or more embodiments the band 100 may include more than two arms.

In the illustrated embodiment, each arm 102, 103 defines an inwardly-facing channel 104 having open ends 105, 106. As best illustrated in FIG. 1E, each of the inwardly-facing channels 104 is defined by a flat or substantially flat upper flange 107 (e.g., an upper horizontal flange), a flat or substantially flat lower flange 108 (e.g., a lower horizontal flange) spaced apart from the upper flange 107, and a sidewall 109 (e.g., a vertical sidewall) extending between outer ends of the upper and lower flanges 107, 108. In the illustrated embodiment, the upper and lower flanges 107, 108 are substantially parallel to each other, and the sidewall 109 is substantially orthogonal to the upper and lower flanges 107, 108 such that flanges 107, 108 and the sidewall 109 together have a generally sideways U-shaped cross-section (e.g., a C-shaped cross-section) and the inwardly-facing channel 104 has a generally square cross-sectional shape. Although in the illustrated embodiment the inwardly-facing channels 104 have a generally square cross-sectional shape, in one or more embodiments the inwardly-facing channels 104 may have any other suitable shape depending, for instance, on the configuration of the components (e.g., the lid L and the container C) the locking band 100 is configured to secure together. For example, in one or more embodiments, the upper and lower flanges 107, 108 may be angled away or toward each other (e.g., upward or downward) such that the inwardly-facing channels 104 have a trapezoidal cross-sectional shape, or the upper and lower flanges 107, 108 and the sidewall 109 may be rounded such that inwardly-facing channels 104 have a semi-circular cross-section. When the first and second arms 102, 103 are connected together in the closed position, the inwardly-facing channels 104 of the first and second arms 102, 103 and the open ends 105, 106 of the inwardly-facing channels 104 cooperate to define a continuous channel (e.g., a rectangular inwardly-facing channel extending continuously around an entirety of the band 101). When the arms 102 and 103 are properly mounted on the lid L and the container C in the closed position, the upper flanges 107, the lower flanges 108, and the sidewalls 109 of the arms 102 and 103 are wrapped around the interfacing peripheral portions of lid L and the container C forming the generally continuous enclosure locking band 100, as shown in FIG. 1F, FIG. 1H and FIG. 1I, to prevent detachment of the lid L from the container C and block access to the interior of the container C from its opening.

Additionally, in the illustrated embodiment, each of the first and second arms 102, 103 includes a rounded (e.g., curved) outwardly-facing surface 110. In the illustrated embodiment, the rounded outwardly-facing surface 110 extends along the upper flange 107, the sidewall 109, and the lower flange 108. In one or more embodiments, the outwardly-facing surface 110 may have any other suitable shape, such as, for instance, one or more flat (i.e., planar) surfaces.

Figure 1B:
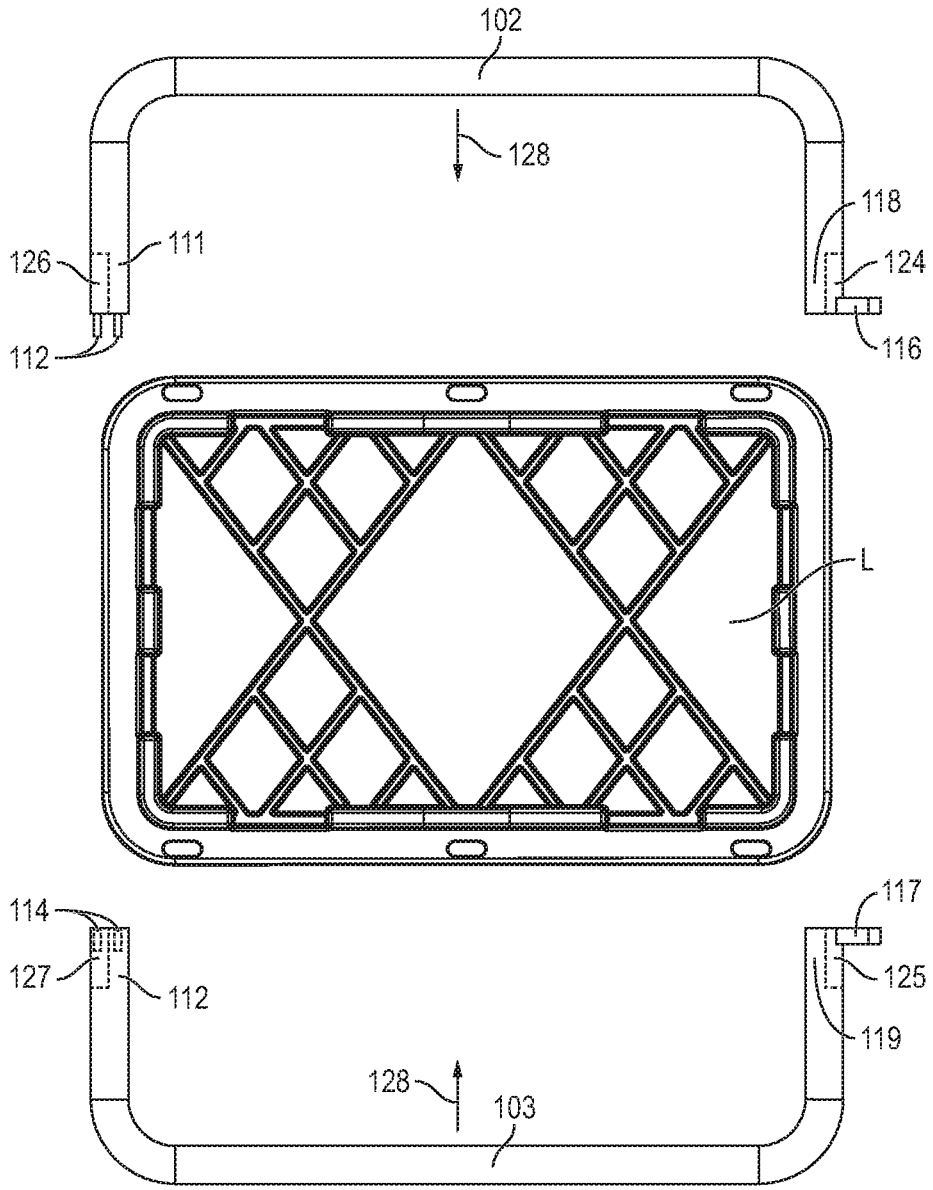
Figure 1C:
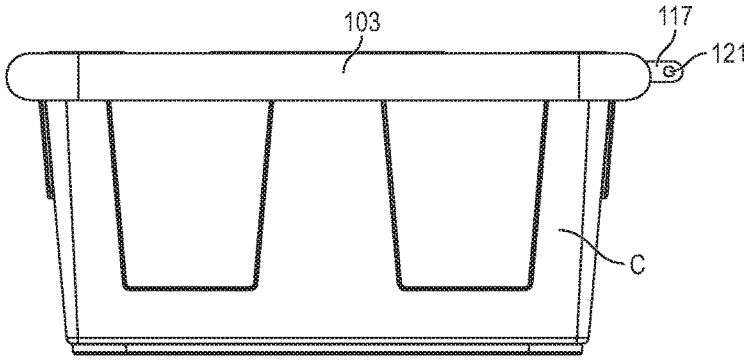
Figure 1D:
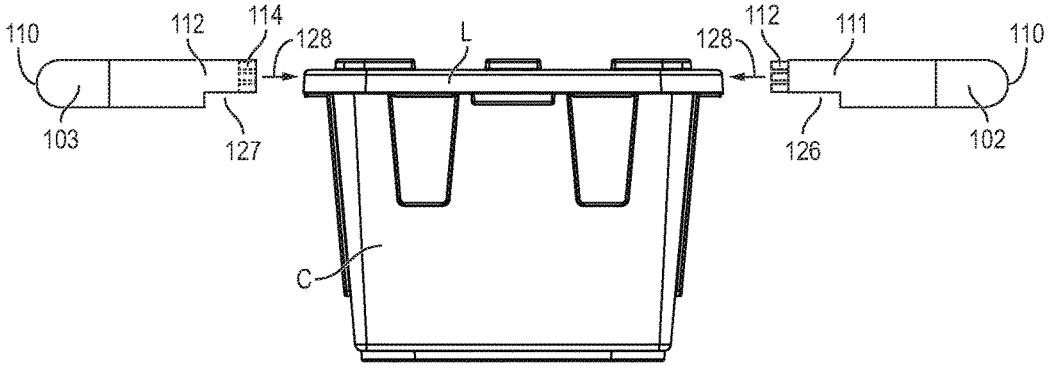
Figure 1E:
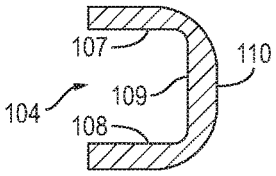
FIG. 1E is an enlarged detail view of an end section of the embodiment of the locking band illustrated in FIGS. 1A-1D.
Figure 1F:
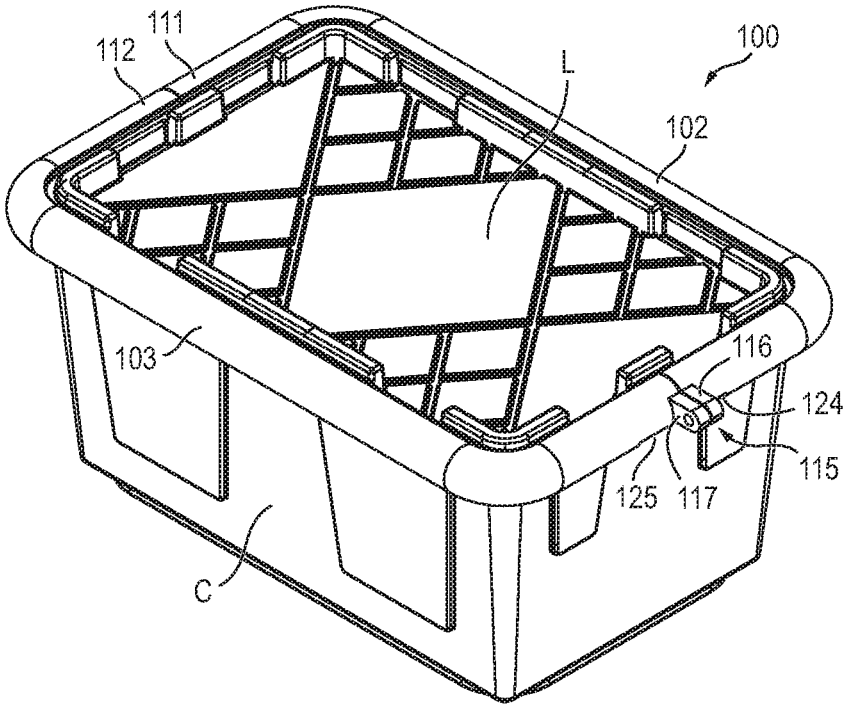
FIGS. 1F-1I illustrate a perspective view, a top view, a side view, and an end view, respectively, of the embodiment of the locking band illustrated in FIGS. 1A-1D in an engaged position securing a lid to a container.
Figure 1G:
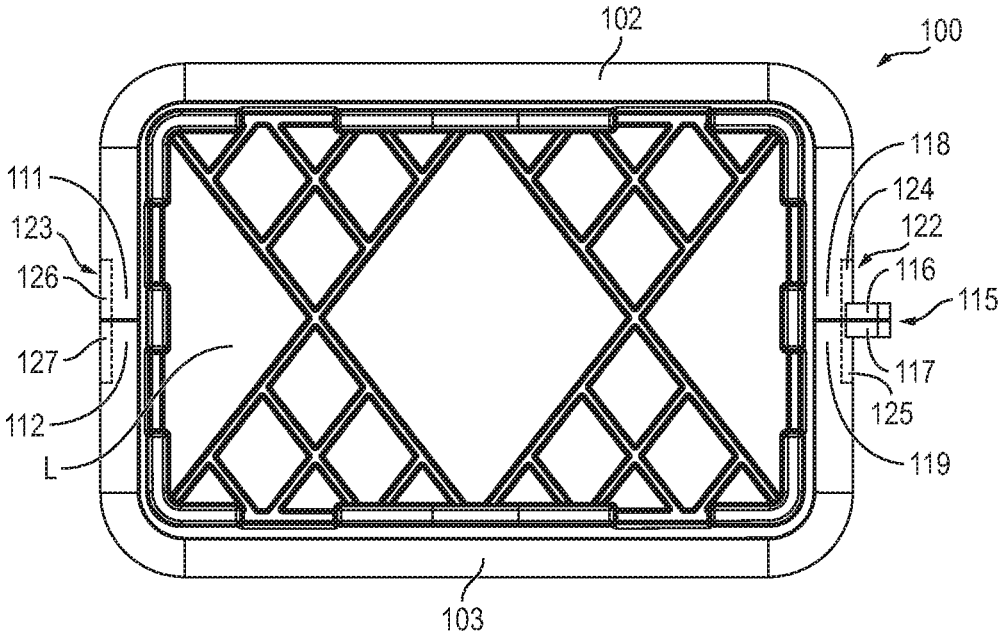
Figure 1H:
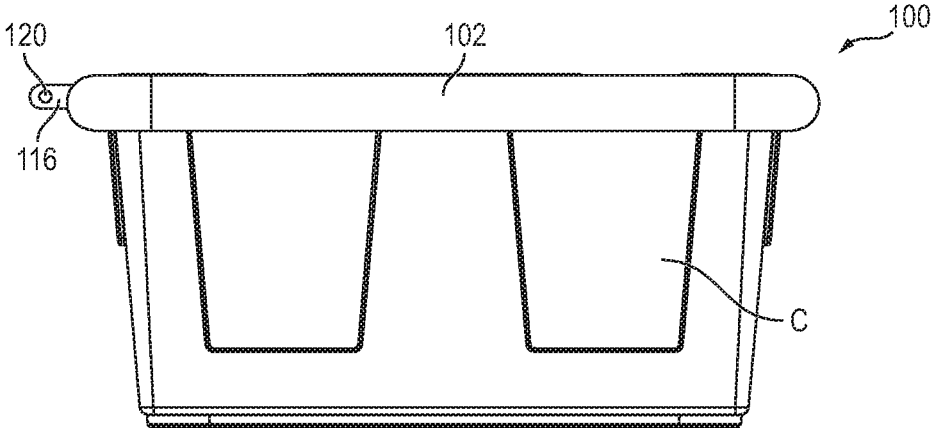
Figure 1I:
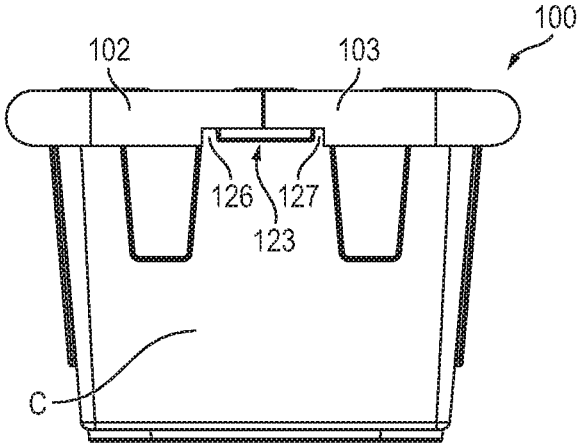

With reference now to FIGS. 1A-1C, a first end 111 of the first arm 102 includes a series of locating pins or alignment pins 112, and a first end 113 of the second arms 103 includes a series of corresponding locating receptacles or alignment receptacles 114 configured to receive the alignment pins 112 when the first and second arms 102, 103 are engaged with each other in the closed position, as illustrated in FIGS. 1F-1I. The engagement between the alignment pins 112 and the alignment receptacles 114 is configured to ensure proper alignment between the first and second arms 102, 103 when they are in the engaged position (e.g., the alignment pins 112 may be guided into the alignment receptacles 114 while moving the first and second arms 102, 103 into the engaged position). In the illustrated embodiment, the alignment pins 112 are cylindrical projections extending from the first end 111 of the first arm 102, and the alignment receptacles 114 are cylindrical blind holes extending from the first end 113 of the second arm 103, although in one or more embodiments the alignment pins and receptacles 112, 114 may be any other suitable shape, such as, for instance, a prismatic shape (e.g., rectangular prisms) or any other suitable non-prismatic shape (e.g., a frusto-conical shape). Additionally, although in the illustrated embodiment the first arm 102 includes three alignment pins 112 and the second arm 103 includes three alignment receptacles 114, in one or more embodiments, the locking band 100 may include any other suitable number of alignment pins and receptacles 112, 114, such as, for instance, fewer than three pairs of alignment pins and receptacles (e.g., one or two alignment pins and a corresponding number of alignment receptacles) or more than three pairs of alignment pins and receptacles. Although in the illustrated embodiment the alignment pins 112 are on the first arm 102 and the alignment receptacles 114 are in the second arm 103, in one or more embodiments, the alignment pins 112 may be on the second arm 103 and the alignment receptacles 114 may be in the first arm 102. Additionally, in one or more embodiments, the band 100 may include any other suitable feature or features for ensuring proper alignment between the first and second arms 102, 103, such as, for instance, a lap joint, grooves, rails, or a combination thereof, instead of, or in addition to, the alignment pins and receptacles 112, 114.

With continued reference to the embodiment illustrated in FIGS. 1A-1I, the locking band 100 also includes a lock-receiving or fastener-receiving mechanism 115 (see FIG. 1F and FIG. 1G) for receiving a fastener for locking or releasably locking the first and second arms 102, 103 together in the closed position around the lid L and the container C.

In the illustrated embodiment, the fastener-receiving mechanism 115 includes a pair of lugs 116, 117 at second ends 118, 119, respectively, of the first and second arms 102, 103 opposite to the first ends 111, 113, respectively, of the first and second arms 102, 103. The lugs 116, 117 are configured to receive a fastener (e.g., a padlock, a bolt, a carabiner, a wire tie, or a pin) to secure the first and second arms 102, 103 together in the closed position. In the illustrated embodiment, the lugs 116, 117 are configured to contact each other when the first and second arms 102, 103 are in the fully engaged (i.e., closed) position. In the illustrated embodiment, each lug 116, 117 is a rounded rectangular plate defining a through hole 120, 121, although in one or more embodiments, the lugs 116, 117 may have any other configuration suitable for receiving a fastener to secure the first and second arms 102, 103 together. In the illustrated embodiment, when the first and second arms 102, 103 are in the fully engaged position, inner surfaces of the lugs 116, 117 contact (e.g., abut) each other and the through hole 120 in the lug 116 of the first arm 102 is aligned with the through hole 121 in the lug 117 of the second arm 103 to enable insertion of the fastener through the lugs 116, 117. The fastener may be secured to the lugs 116, 117 by, for example, threading a nut onto the fastener and/or inserting a cotter pin through the fastener.

With reference now to the embodiment illustrated in FIGS. 1B, 1D, 1G, and 1I, the band 101 defines a pair of opposing indentations or notches 122, 123 (i.e., a first notch 122 and a second notch 123) configured to facilitate carrying an assembly of the lid L, the container C, and the band 100 by exposing portions of the lower surfaces along the periphery of the lid L and the container C (e.g., the notches 122, 123 define spaces for a user to insert his or her hands to lift and carry an assembly of the lid L, the container C, and the band 100). In the illustrated embodiment, the first notch 122 is defined by a first notch segment 124 in the first arm 102 proximate to the first end 111 of the first arm 102, and a first notch segment 125 in the second arm 103 proximate to the first end 113 of the second arm 103. In the illustrated embodiment, the notch segments 124, 125 extend all the way to the first ends 111, 113 of the arms 102, 103, respectively, such that the notch segments 124, 125 cooperate to define a continuous notch 122 when the first and second arms 102, 103 are connected in the closed position. In the illustrated embodiment, the second notch 123 is defined by a second notch segment 126 in the first arm 102 proximate to the second end 118 of the first arm 102, and a second notch segment 127 in the second arm 103 proximate to the second end 119 of the second arm 103. In the illustrated embodiment, the notch segments 126, 127 extend all the way to the second ends 118, 119 of the arms 102, 103, respectively, such that the notch segments 126, 127 cooperate to define a continuous notch 123 when the first and second arms 102, 103 are connected in the closed position. Accordingly, in the illustrated embodiment, the opposing notches 122, 123 are provided at the joints between the first and second arms 102, 103. Additionally, in the illustrated embodiment, the notch segments 124-127 are defined in the lower flanges 108 and the sidewalls 109 of the first and second arms 102, 103. In one or more embodiments, the band 101 may define any other suitable number of notches 122, 123 (e.g., two pairs of opposing notches) and the notches 122, 123 may be arranged in any other suitable locations on the band 101 (e.g., the notches 122, 123 may be defined along the relatively longer sides of the band 101 or along both the relatively shorter ends and the relatively longer sides of the band 101).

To install the band 100 to secure the lid L to the container C, the first and second arms 102, 103 in the open position may first be aligned with the peripheral portions of the lid L and the container C at the interface between the lid L and the container C. The first and second arms 102, 103 may then be slid (arrow 128) toward each other along the peripheral portions of the lid L to the container C. As the first and second arms 102, 103 are advanced toward each other, the alignment pins 112 on the first arm 102 may be guided into the corresponding alignment receptacles 114 in the second arm 103 to ensure the proper alignment between the first and second arms 102, 103. The first and second arms 102, 103 may be advanced toward each other until the band 100 is in the closed position, as shown in FIGS. 1F-1I, at which point the alignment pins 112 are fully inserted into the corresponding alignment receptacles 114 and the lugs 116, 117 are contacting each other. When the band 100 is in the closed position, the peripheral portions of the lid L and the container C extend into the inwardly-facing channels 104 defined by the band 100 and the upper flanges 107 of the band 101 engages an upper surface of the peripheral portion of the lid L and the lower flange 108 of the band 100 engages a lower surface of the peripheral portion of the container C. The band 100 thus effectively wraps around the interfacing peripheral portions of the lid L and the container C, which prevents the lid L from being inadvertently separated from the container C. In the illustrated embodiment, when the band 100 is in the closed position and engaged with the lid L and the container C, the band 100 extends entirely or substantially entirely around a periphery of the lid L and a periphery of the container C, which supplies a uniform and continuous or substantially uniform and continuous pressure at the interface between the lid L and the container C. Additionally, when the band 100 is in the closed position, a fastener (e.g., a padlock) may be inserted through the lugs 116, 117 in the first and second arms 102, 103 to prevent the first and second arms 102, 103 from inadvertently sliding apart from each other into the open position and thereby disengaging the lid L and the container C. Although the installation of the band 100 has been described above with reference to securing a lid to a container, in one or more embodiments, the band 100 may be used to secure any interfacing structures of other suitable components together.

With reference now to FIGS. 2A-2J, a locking band 200 according to another embodiment of the present disclosure includes a first arm 202 hingedly coupled to a second arm 203 by a hinge 204. The locking band 200 is configured to rotate (arrow 205) about the hinge 204 between an open configuration (as shown in FIGS. 2A-2E) and a closed configuration (as shown in FIGS. 2G-2J).

In the illustrated embodiment, each arm 202, 203 defines an inwardly-facing channel 206 having open ends 207, 208. As best illustrated in FIG. 2F, each of the inwardly-facing channels 206 is defined by a flat or substantially flat upper flange 209 (e.g., an upper horizontal flange), a flat or substantially flat lower flange 210 (e.g., a lower horizontal flange) spaced apart from the upper flange 209, and a sidewall 211 (e.g., a vertical sidewall) extending between outer ends of the upper and lower flanges 209, 210. In the illustrated embodiment, the upper and lower flanges 209, 210 are substantially parallel to each other and the sidewall 211 is substantially orthogonal to the upper and lower flanges 209, 210 such that the flanges 209, 210 and the sidewall 211 together have a generally sideways U-shaped cross-section (e.g., a C-shaped cross-section) and the inwardly-facing channel 206 has a generally square cross-sectional shape. Although in the illustrated embodiment the inwardly-facing channels 206 have a generally square cross-sectional shape, in one or more embodiments the inwardly-facing channels 206 may have any other suitable shape depending, for instance, on the configuration of the components (e.g., the lid L and the container C) the locking band 200 is configured to secure together. For example, in one or more embodiments, the upper and lower flanges 209, 210 may be angled away or toward each other (e.g., upward or downward) such that the inwardly-facing channels 206 have a trapezoidal cross-sectional shape, or the upper and lower flanges 209, 210 and the sidewall 211 may be rounded such that inwardly-facing channels 206 have a semi-circular cross-section. When the first and second arms 202, 203 are connected together in the closed position, the inwardly-facing channels 206 of the first and second arms 202, 203 and the open ends 207, 208 of the inwardly-facing channels 206 cooperate to define a continuous channel (e.g., a rectangular inwardly-facing channel extending continuously around an entirety of the locking band 200).

Additionally, in the illustrated embodiment, each of the first and second arms 202, 203 includes a rounded (e.g., curved) outwardly-facing surface 212. In the illustrated embodiment, the rounded outwardly-facing surface 212 extends along the upper flange 209, the sidewall 211, and the lower flange 210. In one or more embodiments, the outwardly-facing surface 212 may have any other suitable shape, such as, for instance, one or more flat (i.e., planar) surfaces.

Figure 2A:
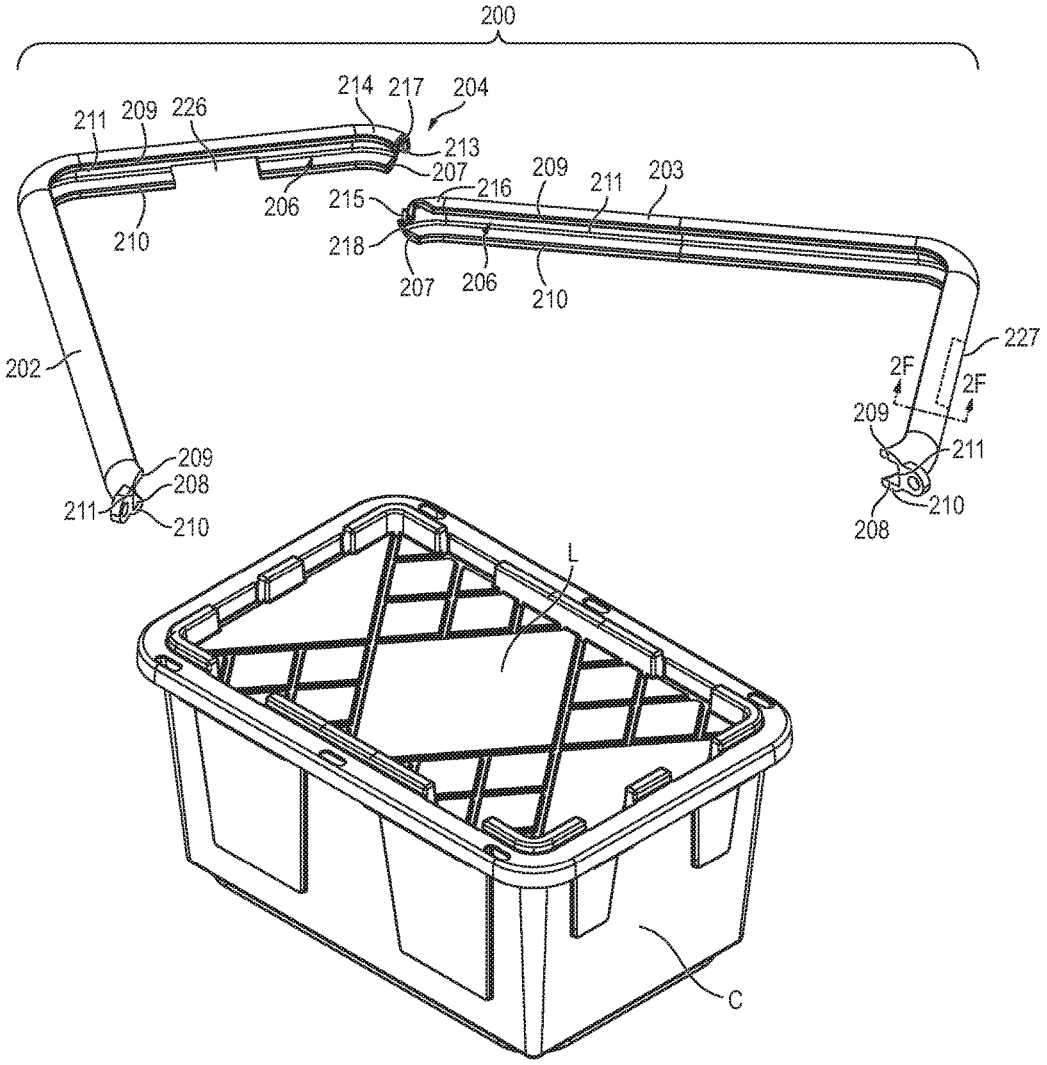
FIGS. 2A-2E illustrate an exploded perspective view, a perspective view, a top view, a side view, and an end view, respectively, of a locking band according to another embodiment of the present disclosure in a disengaged position.
Figure 2B:
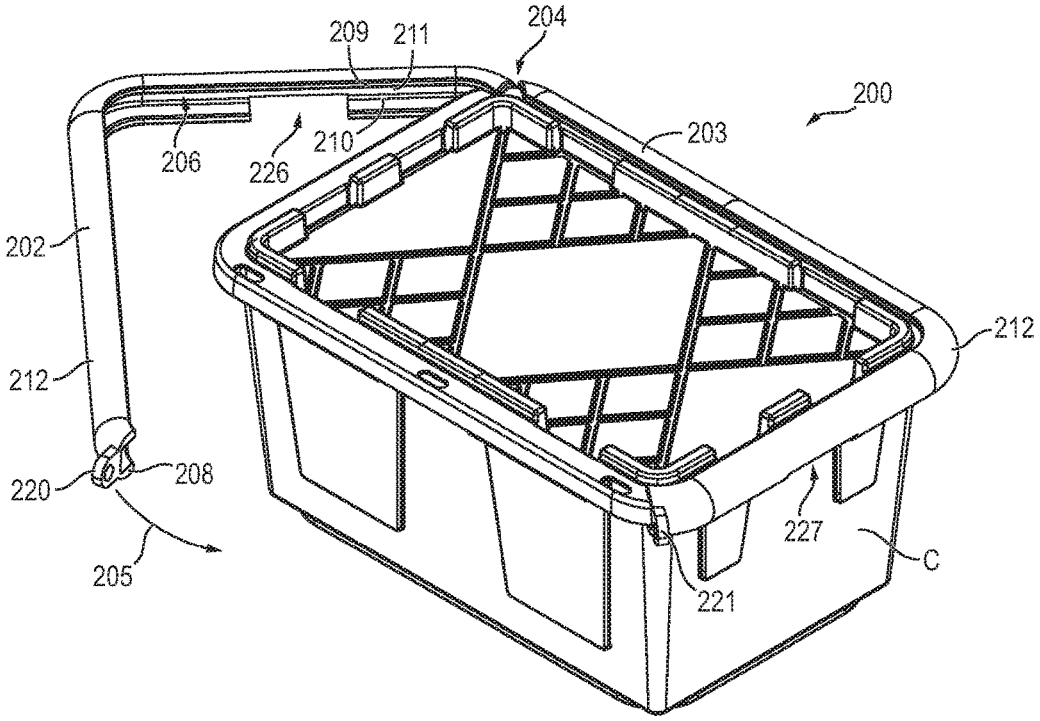
Figure 2C:
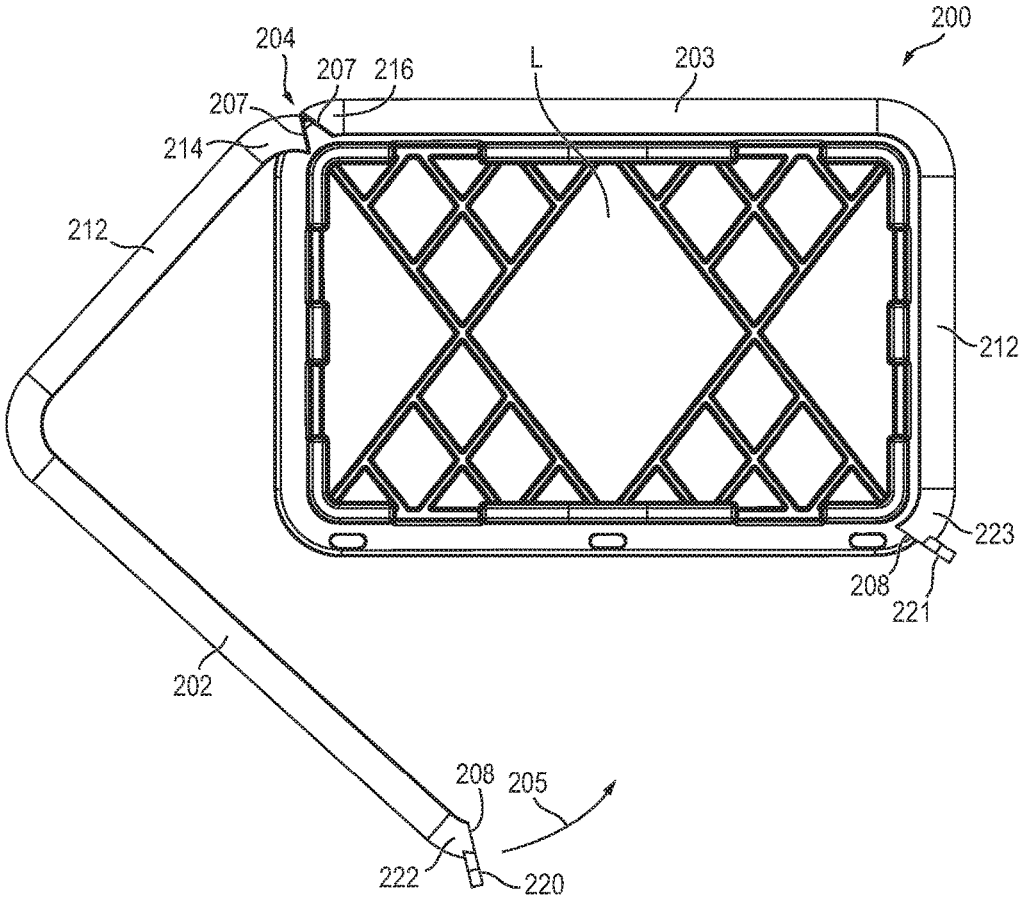
Figure 2D:
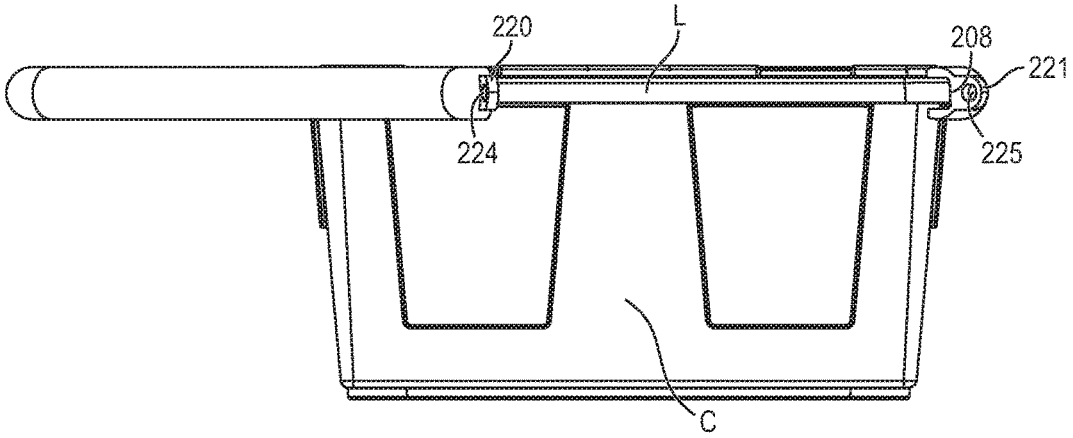
Figure 2E:
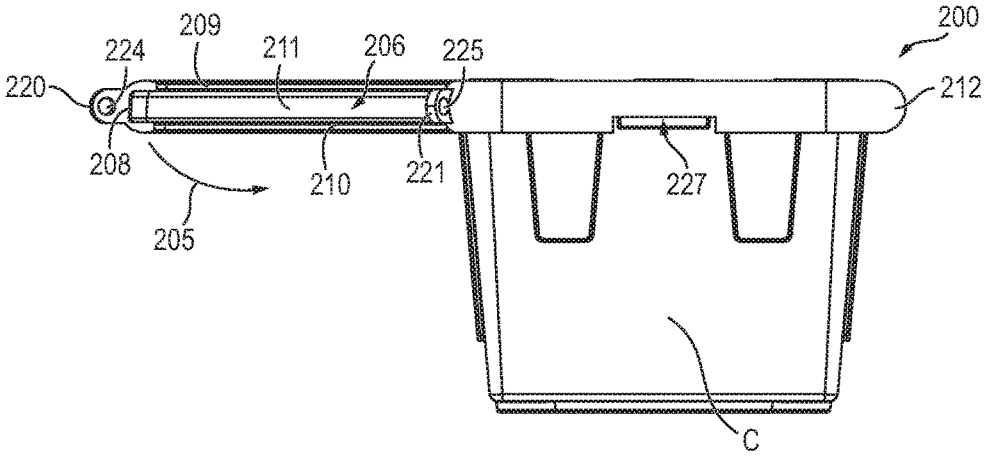
Figure 2F:
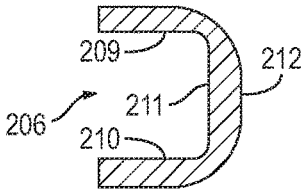
FIG. 2F is an enlarged detail view of an end section of the embodiment of the locking band illustrated in FIGS. 2A-2E.
Figure 2G:
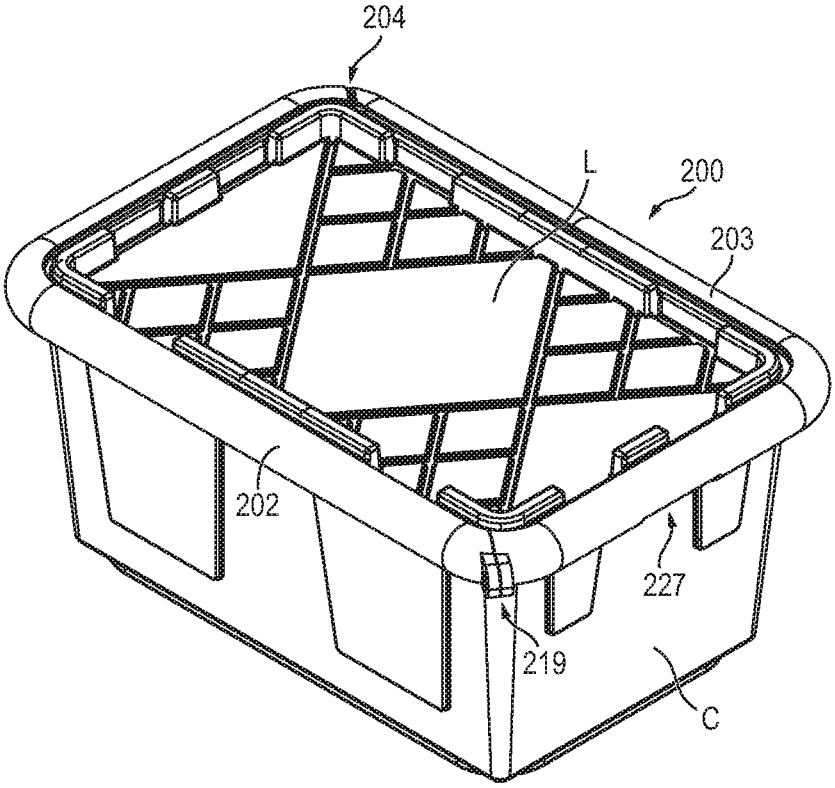
FIGS. 2G-2J illustrate a perspective view, a top view, a side view, and an end view, respectively, of the embodiment of the locking band illustrated in FIGS. 2A-2E in an engaged position securing a lid to a container.
Figure 2H:
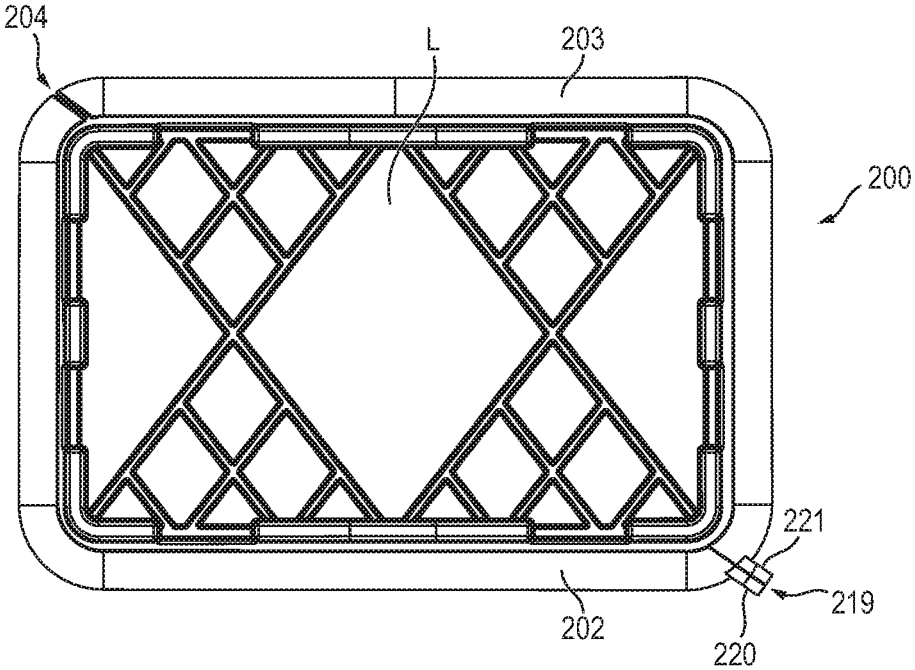
Figure 2I:
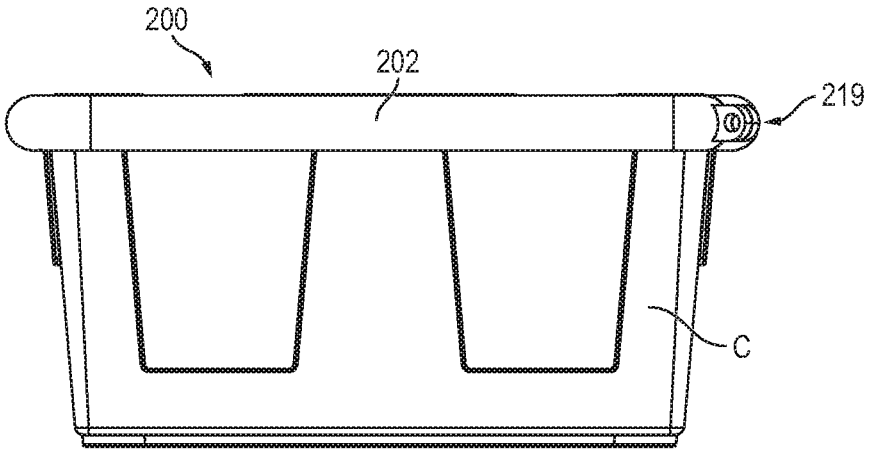
Figure 2J:
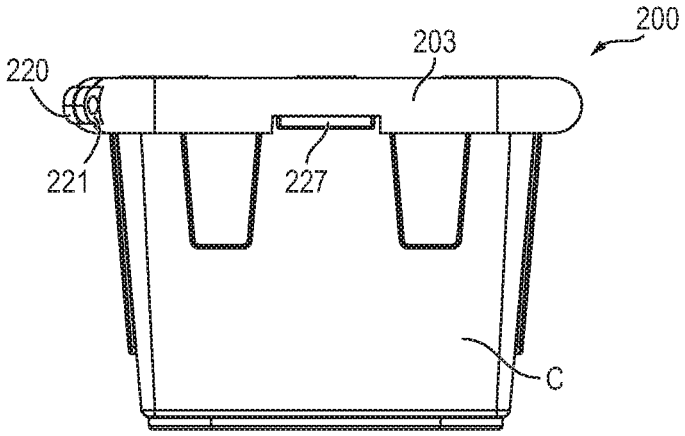
Figure 3A:
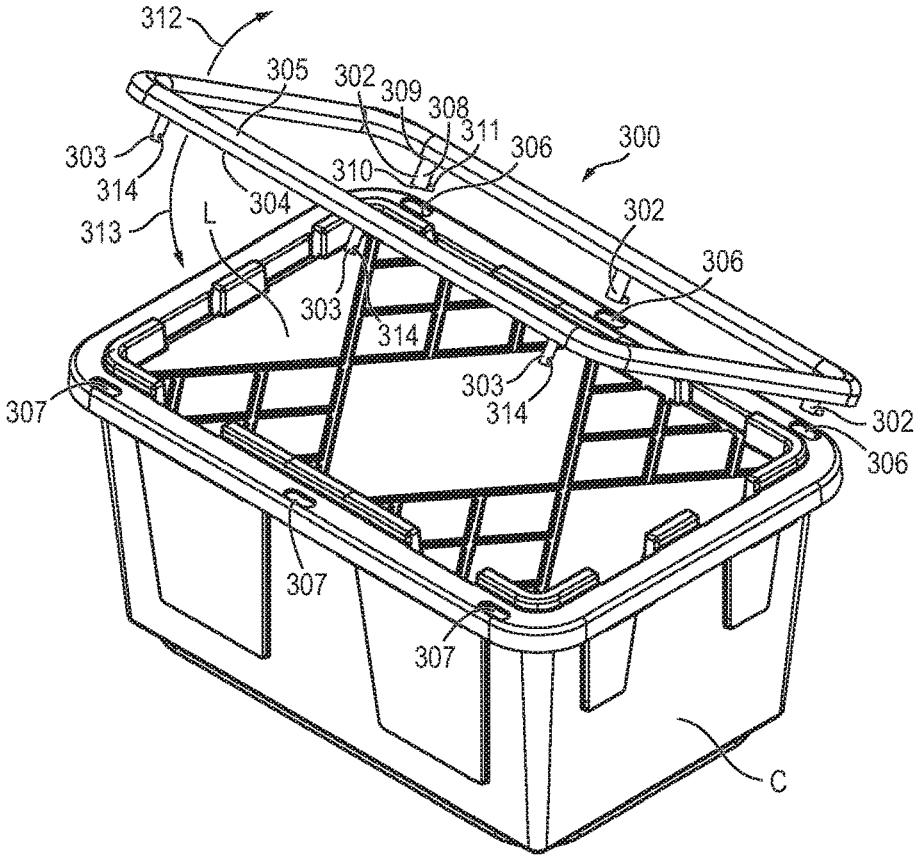
FIGS. 3A-3D is a perspective view, a top view, a side view, and an end view, respectively, of a locking band according to a further embodiment of the present disclosure in a disengaged position.
Figure 3B:
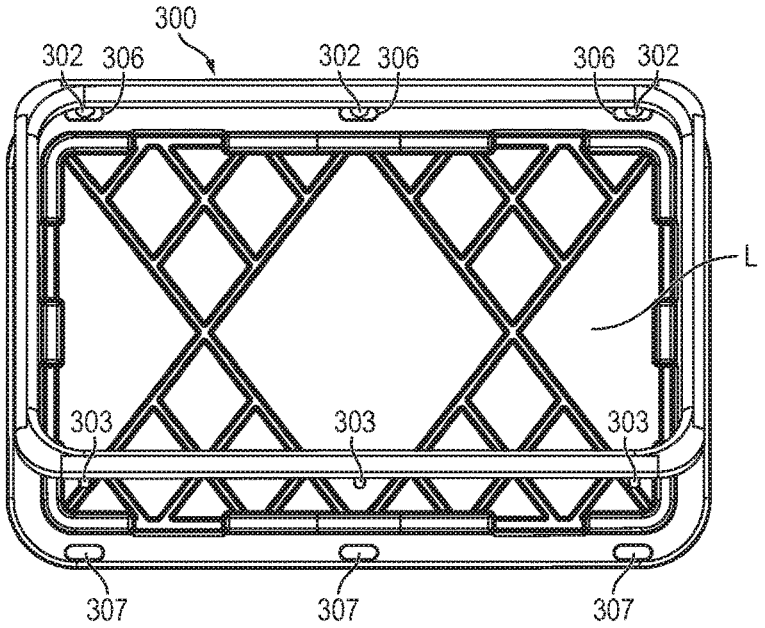
Figure 3C:
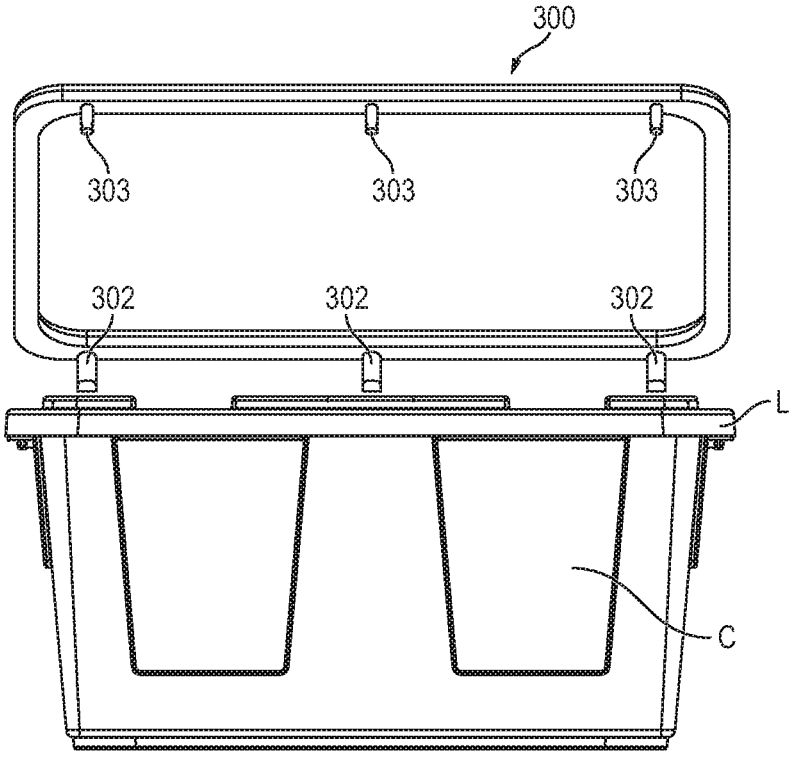
Figure 3D:
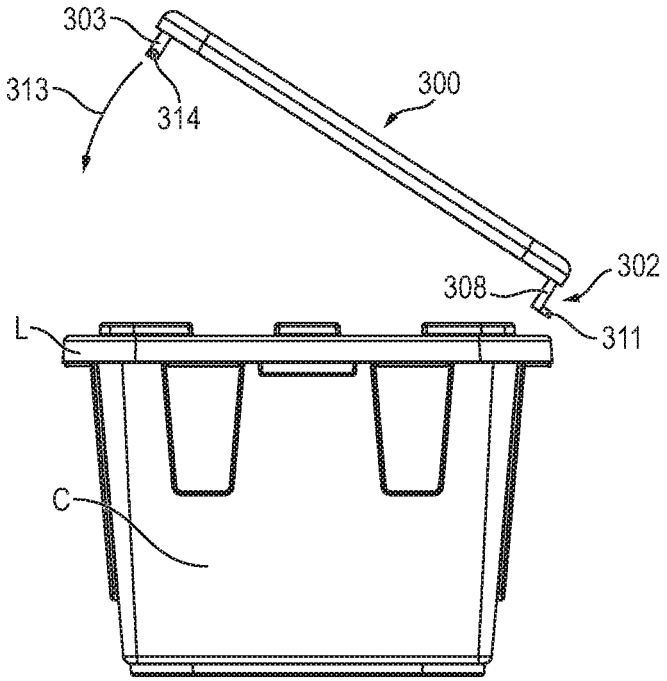
Figure 3E:
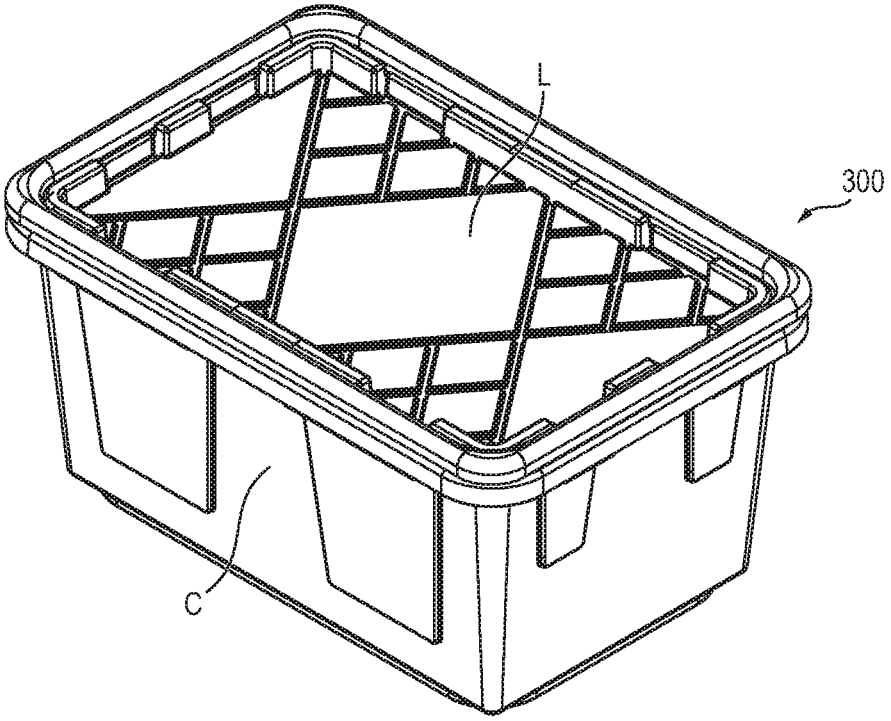
FIGS. 3E-3I illustrate a perspective view, a top view, a side view, an end view, and a bottom view, respectively, of the embodiment of the locking band illustrated in FIG. 3A in an engaged position securing a lid to a container.
Figure 3F:
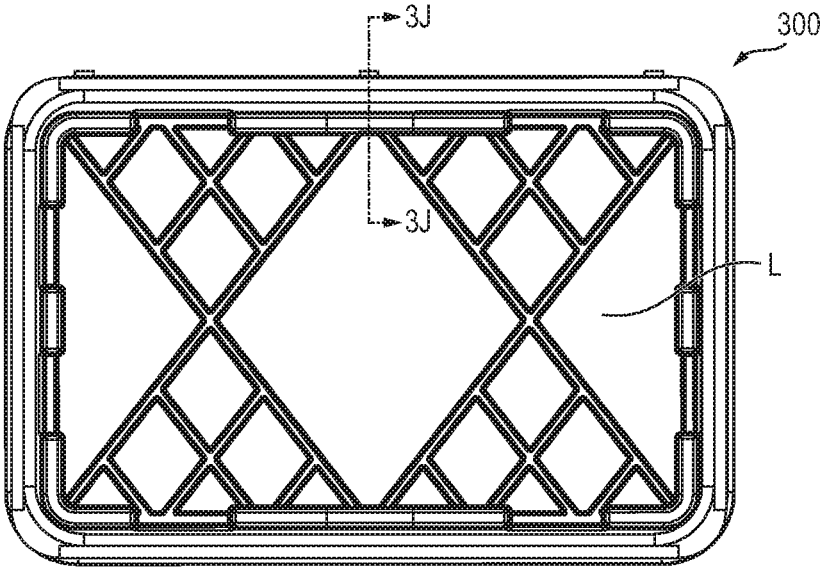
Figure 3G:
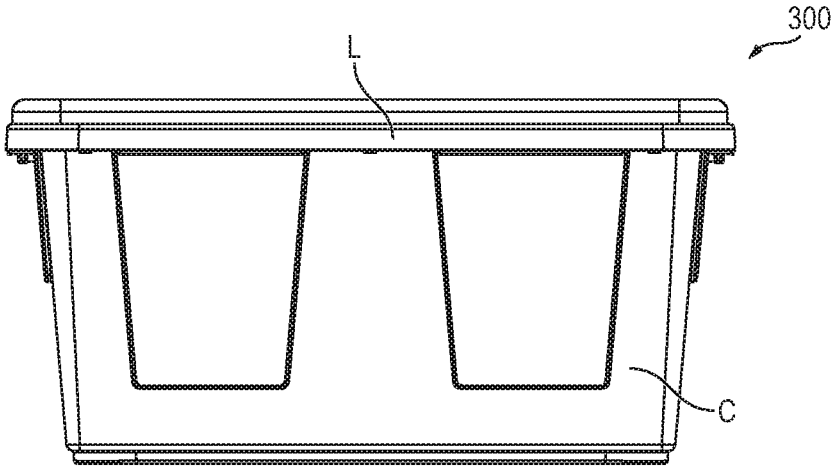
Figure 3H:
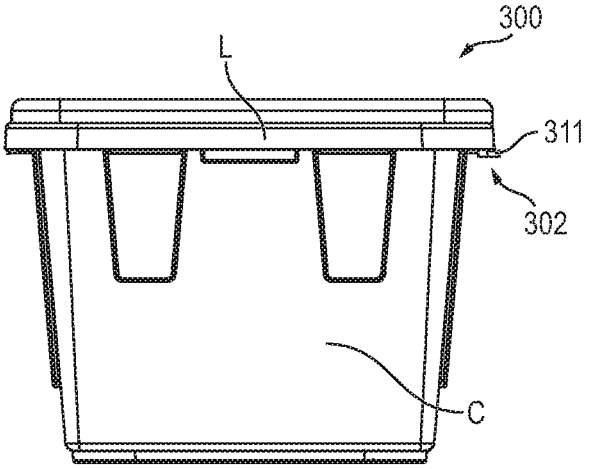
Figure 3I:
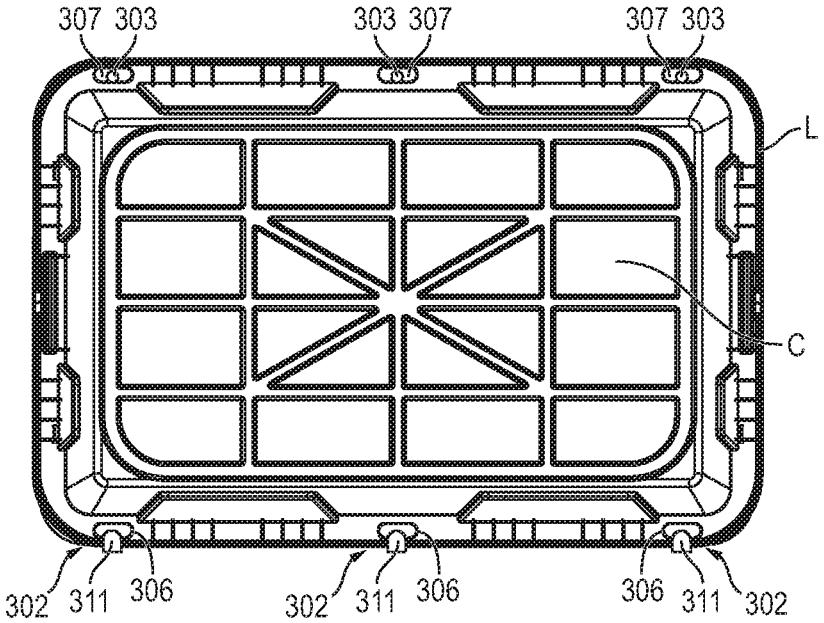
Figure 3J:
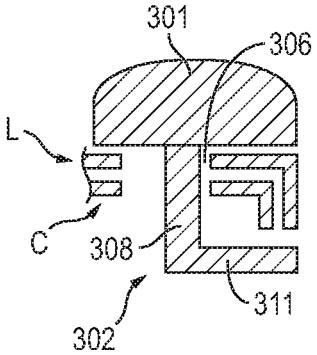
FIG. 3J is an enlarged cross-sectional view of a hook of the locking band engaging a portion of the lid and the container.

With reference now to the embodiment illustrated in FIG. 2A, the hinge 204 includes a receptacle 213 defined in a first end 214 of the first arm 202 and a post or pin 215 at a first end 216 of the second arm 203. The receptacle 213 is configured to receive the pin 215. In one or more embodiments, the pin 215 may be provided on the first arm 202 and the receptacle 213 may be defined in the second arm 203. In the illustrated embodiment the pin 215 extends upward, and the receptacle 213 has an open end facing downward configured to receive the pin 215. In one or more embodiments, the pin 215 may extend downward and the receptacle 213 may extend downward and have an open end facing upward such that the pin 215 is configured to extend down into the receptacle 213. Additionally, in the illustrated embodiment, the first end 214 of the first arm 202 includes an overlapping portion 217 configured to overlap an underlapping portion 218 at the first end 216 of the second arm 203. Together, the overlapping and underlapping portions 217, 218 of the arms 202, 203 define a lap joint at the hinge 204. In the illustrated embodiment, the receptacle 213 is defined in the overlapping portion 217 of the first arm 202, and the pin 215 extends from the underlapping portion 218 of the second arm 203, although in one or more embodiments the receptacle 213 may be defined in the underlapping portion 218 and the pin 215 may extend from the overlapping portion 217. In one or more embodiments, the hinge 204 may have any other suitable configuration, such as, for instance, a live hinge (e.g., a thin flexible hinge made from the same material as the first and second arms 202, 203).

With continued reference to the embodiment illustrated in FIGS. 2A-2J, the locking band 200 also includes a fastener-receiving mechanism 219 for releasably locking the first and second arms 202, 203 together in the closed position. In the illustrated embodiment, the locking mechanism 219 includes a pair of lugs 220, 221 at second ends 222, 223, respectively, of the first and second arms 202, 203 opposite to the first ends 214, 216 of the first and second arms 202, 203. The lugs 220, 221 are configured to receive a fastener (e.g., a padlock, a bolt, a carabiner, a wire tie, or a pin) to secure the first and second arms 202, 203 together in the closed position. In the illustrated embodiment, the lugs 220, 221 are configured to contact each other when the first and second arms 202, 203 are in the fully engaged (i.e., closed) position. In the illustrated embodiment, each lug 220, 221 is a rounded rectangular plate defining a through-hole 224, 225, although in one or more embodiments, the lugs 220, 221 may have any other configuration suitable for receiving a fastener to secure the first and second arms 202, 203 together. In the illustrated embodiment, when the first and second arms 202, 203 are in the fully engaged position, inner surfaces of the lugs 220, 221 contact (e.g., abut) each other and the through hole 224 in the lug 220 of the first arm 202 is aligned with the through hole 225 in the lug 221 of the second arm 203 to enable insertion of the fastener through the lugs 220, 221. The fastener may be secured to the lugs 220, 221 by, for example, threading a nut onto the fastener and/or inserting a cotter pin through the fastener. Additionally, in the illustrated embodiment, the fastener-receiving mechanism 219 is opposite the hinge 204. In the illustrated embodiment in which the band 201 is rectangular, the fastener-receiving mechanism 219 and the hinge 204 are provided at two opposite corners of the locking band 200. In one or more embodiments, the locking mechanism 219 and the hinge 204 may be provided at any other suitable locations along the locking band 200.

With reference now to the embodiment illustrated in FIGS. 2A, 2B, 2E, and 2J, the band 201 defines a pair of opposing indentations or notches 226, 227 (i.e., a first notch 226 and a second notch 227) configured to facilitate carrying an assembly of the lid L, the container C, and the locking band 200 by exposing portions of the lower surfaces along the periphery of the lid L and the container C (e.g., the notches 226, 227 define spaces for a user to insert his or her hands to lift and carry an band of the lid L, the container C, and the locking band 200). In the illustrated embodiment, the first notch 226 is positioned along the shorter end of the first arm 202 and the second notch 227 is positioned along the shorter end of the second arm 203. Additionally, in the illustrated embodiment, the first and second notches 226, 227 are defined in the lower flanges 210 and the sidewalls 211 of the first and second arms 202, 203, respectively. In one or more embodiments, the band 201 may define any other suitable number of notches 226, 227 (e.g., two pairs of opposing notches) and the notches 226, 227 may be arranged in any other suitable locations on the band 201 (e.g., the notches 226, 227 may be defined along the relatively longer sides of the band 201 or along both the relatively shorter ends and the relatively longer sides of the band 201).

To install the locking band 200 to secure the lid to the container, the first and second arms 202, 203 may first be rotated (arrow 205) about the hinge 204 into the open position. The inwardly-facing channels 206 defined by the locking band 200 may then be aligned with the peripheral portions of the lid L and the container C at the interface between the lid L and the container C. The locking band 200 may then be wrapped around the peripheral portions of the lid L and the container C by rotating (arrow 205) the first and second arms 202, 203 about the hinge 204 into the closed position. When the locking band 200 is in the closed position, the peripheral portions of the lid L and the container C extend into the inwardly-facing channels 206 defined by the band 206 and the upper flanges 209 of the band 201 engages an upper surface of the peripheral portion of the lid L and the lower flange 210 of the locking band 200 engages a lower surface of the peripheral portion of the container C. With the arms 202 and 203 properly mounted on the lid L and container C in the closed position, the upper flanges 209, the lower flanges 210, and the sidewalls 211 of the arms 202 and 203 are wrapped around the interfacing peripheral portions of lid and the container forming the generally continuous enclosure locking band 200, as shown in FIG. 2G, FIG. 2H, FIG. 2I, and FIG. 2J, to prevent detachment of the lid L from the container C and block access to the interior of the container C from its opening. In the illustrated embodiment, when the locking band 200 is in the closed position and engaged with the lid L and the container C, the locking band 200 extends generally entirely around a periphery of the lid L and a periphery of the container C, which supplies a uniform and continuous or substantially uniform and continuous pressure at the interface between the lid L and the container C. Additionally, when the locking band 200 is in the closed position, a fastener may be inserted through the lugs 220, 221 in the first and second arms 202, 203 to prevent the first and second arms 202, 203 from inadvertently rotating (arrow 205) into the open position and thereby disengaging the lid L and the container C. Although the installation of the locking band 200 has been described above with reference to securing a lid to a container, in one or more embodiments, the locking band 200 may be used to secure together interfacing peripheral structures of any other suitable components.

With reference now to FIGS. 3A-3J, a locking band 300 according to another embodiment of the present disclosure includes band 300*a* plurality of hooks 302, each extending downward from an underside of the locking band 300, and a plurality of prongs 303 extending downward from the band 300. In the illustrated embodiment, the locking band 300 is a monolithic member. Additionally, in the embodiment, the locking band 300 is rectangular and includes a pair of opposing relatively longer sides and a pair of opposing relatively shorter ends, although in one or more embodiments the locking band 300 may have any other suitable shape, depending, for instance, on the configuration (e.g., the shape) of the components the locking band 300 is configured to engage (e.g., the locking band 300 may have any shape corresponding or substantially corresponding to the shape of the lid and container the locking band 300 is configured to engage). In the illustrated embodiment, the locking band 300 has a generally solid cross-section and includes a generally flat (e.g., planar) lower, outer surface 304 and a rounded upper, outer surface 305 opposite to the lower, outer surface 304. In one or more embodiments, the lower, outer surface 304 of the locking band 300 may have any other suitable configuration (e.g., shape) depending on the configuration of the lid L or other component the locking band 300 is configured to engage. For example, the lower surface 304 of the locking band 300 may be non-planar in order to engage a lid having a non-planar surface. In the illustrated embodiment, the hooks 302 are located on one of the relatively longer sides and the prongs 303 are located on the other of the relatively longer sides, such that the hooks 302 and the prongs 303 are opposite of each other.

In the illustrated embodiment, the locking band 300 includes three hooks 302 arranged along one of the relatively longer sides of the locking band 300 and three prongs 303 arranged along the other relatively longer side of the locking band 300. Additionally, in the illustrated embodiment, the hooks 302 and the prongs 303 are arranged opposite to each other. The hooks 302 are configured to extend into a first set of corresponding openings 306 in the lid L and the container C and the prongs 303 are configured to extend into a second set of corresponding openings 307 in the lid L and the container C. In one or more embodiments, the locking band 300 may include any other suitable number of hooks and prongs 302, 303 and the hooks and prongs 302, 303 may be arranged in any other suitable configuration, depending, for instance, on the number and arrangement of the openings 306, 307 in the lid L and the container C or other components the locking band 300 is configured to engage. Additionally, although in the illustrated embodiment the number of hooks 302 is equal to the number of prongs 303, in one or more embodiments, the number of hooks 302 may be different than the number of prongs 303.

With continued reference to the embodiment illustrated in FIGS. 3A-3J, each of the hooks 302 is L-shaped and includes a stem 308 extending downward from the lower surface 304 of the locking band 300. Each of the stems 308 includes a supported end 309 connected to the lower surface 304 of the locking band 300 and a free end 310 (i.e., unsupported or cantilevered end) opposite to the supported end 309. Each of the hooks 302 also includes a releasable engagement tab or engagement lip 311 extending outwardly from the free end 310 of the stem 308. In the illustrated embodiment, the engagement tabs 311 are orthogonal or substantially orthogonal to the respective stems 308 of the hooks 302, although in one or more embodiments the engagement tabs 311 may have any other suitable orientation relative to the stems 308 (e.g., the engagement tabs 311 may be angled upward such that the engagement tabs 311 define an acute angle relative to the stems 308).

Additionally, in the illustrated embodiment, each of the prongs 303 includes a cylindrical member extending downward from the lower surface 304 of the locking band 300, although in one or more embodiments, the prongs 303 may have any other suitable shape. Accordingly, in the illustrated embodiment, the hooks 302, which are configured differently than the configuration of the prongs 303, facilitate installation of the locking band 300 to secure the lid L to the container C, as described in more detail below.

To install the locking band 300 to secure the lid L to the container C, the locking band 300 may first be tilted or angled (arrow 312) with the hooks 302 of the locking band 300 closer to the lid L than the prongs 303 (as shown in FIGS. 3A-3D). The hooks 302 may then be inserted into the first set of corresponding openings 306 in the lid L to the container C by first passing the engagement tabs 311 of the hooks 302 through the openings 306 and then inserting the stems 308 of the hooks 302 down into the openings 306. In the illustrated embodiment, the engagement tabs 311 are larger (e.g., wider) that the first set of openings 306 in the lid L and the container C, and therefore angling the locking band 300 enables the hooks 302 to pass through the first set of corresponding openings 306 in the lid L and the container C securing the lid L and the container C together along that relatively longer side. The opposing relatively longer side of the band 300 along which the prongs 303 are located may then be rotated downward (arrow 313 in FIGS. 3A and 3D) until the prongs 303 are inserted into the second set of corresponding openings 307 in the lid L and the container C, and the lower surface 304 of the locking band 300 contacts (e.g., rests on) an upper surface of a peripheral portion of the lid L.

When the locking band 300 is installed to secure the lid L and the container C, as illustrated in FIGS. 3E-3J, the stems 308 of the hooks 302 extend down through the first set of corresponding openings 306 in the lid L and the container C and the engagement tabs 311 of the hooks 302 extend outward beyond the openings 306 such that the engagement tabs 311 underlap a portion of the container C. The underlapping configuration secures the lid L and the container C. For instance, when an attempt is made to separate the lid L from the container C by lifting lid L after the locking band 300 is installed, the engagement tabs 311 of the hooks 302, which extend outward beyond the first set of corresponding openings 306 in the lid L and the container C, advantageously contact a surface of the container C and thereby prevent removal of the lid L from the container C. In the illustrated embodiment, when the locking band 300 is in the closed position and engaged with the lid L and the container C, the locking band 300 extends entirely or substantially entirely around a periphery of the lid L and a periphery of the container C, which supplies a uniform and continuous or substantially uniform and continuous pressure at the interface between the lid L and the container C.

Additionally, in the illustrated embodiment, each of the prongs 303 includes an opening 314 (e.g., a circular through hole) extending laterally through the prong 303 (e.g., each of the prongs 303 defines an opening 314 extending in a direction perpendicular or substantially perpendicular to a length direction of the prong 303). The openings 314 in the prongs 303 are configured to receive, for example, fasteners (e.g., padlocks, bolts, and/or pins). When the locking band 300 is installed on the lid L and the container C and the fasteners are secured to the prongs 303, the fasteners (being larger than the second set of openings 307) prevent the prongs 303 from retracting out of the second set of corresponding openings 307 in the lid L and the container C, which prevents the band 300 from disengaging the lid L and the container C, and prevents the lid L from being removed from the container C. In that regard, the second set of openings 307 are sized to be only slightly larger than the width of the prongs 303 in the illustrated embodiment.

To remove the locking band 300 and permit the lid L to be removed the container C, the fasteners, if attached to the prongs 303, are detached from the openings 314 in the prongs 303. The locking band 300 may then be rotated (arrow 312) by lifting the relatively longer side of the locking band 300 along with the prongs 303 are located. As the locking band 300 is rotated (arrow 312), the prongs 303 are withdrawn from the second set of corresponding openings 307 in the lid L and the container C. The longer side of the locking band 300 along which the hooks 302 are located may then be lifted upward (i.e., away from the lid L) to withdraw the hooks 302 from the first set of corresponding openings 306 in the lid L and the container C. Once the prongs 303 and the hooks 302 of the locking band 300 have been removed from the openings 306, 307 in the lid L and the container C, the lid L is free to be detached from the container C.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. It is understood that the drawings are not necessarily to scale and that any one or more features of an embodiment may be incorporated in addition to or in lieu of any one or more features in another embodiment. Although relative terms such as "outer," "inner," "upper," "lower," "below," "above," "vertical," "horizontal," and similar terms have been used herein to describe a spatial relationship of one element to another, it is understood that these terms are intended to encompass different orientations of the various elements and components of the invention in addition to the orientation depicted in the figures. Additionally, as used herein, the term "substantially," "about," "generally" and similar terms are used as terms of approximation and not as terms of degree, and are intended to account for the inherent deviations in measured or calculated values that would be recognized by those of ordinary skill in the art. Moreover, the tasks described above may be performed in the order described or in any other suitable sequence. Additionally, the methods described above are not limited to the tasks described. Instead, for each embodiment, one or more of the tasks described above may be absent and/or additional tasks may be performed. Furthermore, as used herein, when a component is referred to as being "on" another component, it can be directly on the other component or components may also be present therebetween. Moreover, when a component is component is referred to as being "coupled" to another component, it can be directly attached to the other component or intervening components may be present therebetween.

What is claimed is:

1. A locking band for securing a lid to a container, the locking band comprising:

a first arm;

a second arm configured to mate with the first arm, the first and second arms configured to move between a disengaged position and an engaged position;

an inwardly-facing channel defined by the first and second arms, the inwardly-facing channel configured to receive a peripheral portion of the lid and a corresponding peripheral portion of the container;

at least one alignment pin extending from a first end of one of the first and second arms;

at least one alignment receptacle defined in a first end of the other one of the first and second arms, each of the at least one receptacle configured to receive a respective one of the at least one alignment pin when the first and second arms are in the engaged position.

2. The locking band of claim 1, wherein each of the at least one alignment pin is a cylindrical projection extending outward from the first end of the first arm and each of the at least one alignment receptacle is a cylindrical blind hole extending inward from the first end of the second arm.

3. The locking band of claim 1, wherein the band has a rectangular shape when the first and second arms are in the engaged position.

4. The locking band of claim 1, wherein the inwardly-facing channel is defined by a first flange configured to engage a surface of the peripheral portion of the lid, a second flange spaced apart from the first flange configured to engage a surface of the peripheral portion of the container, and a sidewall extending between the first and second flanges.

5. The locking band of claim 4, further comprising at least one notch defined in the second flange configured to expose a portion of the surface of the peripheral portion of the container.

6. The locking band of claim 5, wherein the at least one notch is defined by a first notch segment proximate the first end of the first arm and a second notch segment proximate the first end of the second arm configured to cooperate with the first notch segment when the first and second arms are in the engaged position.

7. The locking band of claim 1, further comprising:

a first lug at a second end of the first arm; and a second lug at a second end of the second arm, wherein the first lug is configured to contact the second lug when the first and second arms are in the engaged position.

8. A locking band configured to secure a lid to a container, the locking band comprising:

a first arm;

a second arm configured to mate with the first arm, the first and second arms configured to move between a disengaged position and an engaged position;

an inwardly-facing channel defined by the first and second arms, the inwardly-facing channel configured to receive a peripheral portion of the lid and a corresponding peripheral portion of the container;

a hinge at first ends of the first and second arms, the hinge configured to facilitate rotating the first and second arms between the disengaged and engaged positions, the hinge comprising a pin at the first end of one of the first and second arms and a receptacle configured to receive the pin at the first end of the other one of the first and second arms; and a lock-receiving mechanism at second ends of the first and second arms opposite the first ends of the first and second arms, the lock-receiving mechanism configured to lock the first and second arms in the engaged position.

9. The locking band of claim 8, further comprising a lap joint defined at the first ends of the first and second arms.

10. The locking band of claim 8, wherein the inwardly-facing channel is defined by a first flange configured to engage a surface of the peripheral portion of the lid, a second flange spaced apart from the first flange configured to engage a surface of the peripheral portion of the container, and a sidewall extending between the first and second flanges.

11. The locking band of claim 10, further comprising a first notch defined in the second flange of the first arm and a second notch defined in the second flange of the second arm to expose portions of a surface of the peripheral portion of the container.

12. The locking band of claim 11, wherein the second notch is opposite to the first notch when the first and second arms are in the engaged position.

13. The locking band of claim 8, further comprising a fastener-receiving mechanism configured to facilitate locking the first and second arms in the engaged position, wherein the fastener-receiving mechanism is opposite the hinge when the first and second arms are in the engaged position.

14. A locking band configured to secure a lid to a container, the locking band comprising:

a band configured to engage a surface of a peripheral portion of the lid;

a plurality of hooks extending in a first direction from the band, the plurality of hooks configured to extend through a first set of aligned openings in the lid and the container;

a plurality of prongs extending in the first direction from the band, the plurality of prongs configured to extend through a second set of aligned openings in the lid and the container.

15. The locking band of claim 14, wherein the band is a monolithic rectangular member comprising a substantially planar surface configured to engage the surface of the peripheral portion of the lid and rounded surface opposite to the substantially planar surface.

16. The locking band of claim 14, wherein each hook of the plurality of hooks is L-shaped.

17. The locking band of claim 14, wherein each prong of the plurality of prongs is a cylindrical member defining an opening configured to receive a fastener.

18. The locking band of claim 14, wherein the plurality of hooks is opposite the plurality of prongs.

19. A locking band configured to secure a lid to a container, the locking band comprising:

a band configured to engage a surface of a peripheral portion of the lid;

a plurality of hooks extending in a first direction from the band, the plurality of hooks configured to extend through a first set of aligned openings in the lid and the container; and a plurality of prongs extending in the first direction from the band, the plurality of prongs configured to extend through a second set of aligned openings in the lid and the container, wherein each hook of the plurality of hooks comprises:

a stem having a supported end at the band and a free end opposite to the supported end, the stem configured to extend through one of the aligned openings of the first set of aligned openings in the lid and the container; and an engagement tab extending outward from the free end of the stem, the engagement tab configured to underlap a portion of the container.

20. A locking band configured to secure a lid to a container, the locking band comprising:

a band configured to engage a surface of a peripheral portion of the lid;

a plurality of hooks extending in a first direction from the band, the plurality of hooks configured to extend through a first set of aligned openings in the lid and the container; and a plurality of prongs extending in the first direction from the band, the plurality of prongs configured to extend through a second set of aligned openings in the lid and the container, wherein the band comprises a pair of relatively longer segments and a pair of relatively shorter segments, and wherein the plurality of hooks is arranged along one of the relatively longer segments and the plurality of prongs is arranged along the other one of the relatively longer segments.

* * * * *